US005292279A

United States Patent [19]

Takemoto et al.

[11] Patent Number: 5,292,279

[45] Date of Patent: Mar. 8, 1994

[54] MEDAL DISTRIBUTION APPARATUS FOR SLOT MACHINE ISLAND

[75] Inventors: Takatoshi Takemoto; Keizo Kasahara, both of Tokyo; Meiji Muramatsu, Yokohama, all of Japan

[73] Assignee: Kabushiki Kaisha Ace Denken, Tokyo, Japan

[21] Appl. No.: 910,123

[22] PCT Filed: Sep. 27, 1991

[86] PCT No.: PCT/JP91/01303

§ 371 Date: Jun. 16, 1992

§ 102(e) Date: Jun. 16, 1992

[87] PCT Pub. No.: WO92/05846

PCT Pub. Date: Apr. 16, 1992

[30] Foreign Application Priority Data

Sep. 27, 1990 [JP] Japan ..... 2-258745

[51] Int. Cl.[5] ..... G07D 1/00

[52] U.S. Cl. ..... 453/56; 198/367

[58] Field of Search ..... 453/56, 7, 11; 198/367

[56] References Cited

U.S. PATENT DOCUMENTS 3,860,017 1/1975 Black et al. ..... 453/56

4,342,384 8/1982 Fukase et al. ..... 453/56 X

FOREIGN PATENT DOCUMENTS 57-17679 1/1982 Japan .

58-26714 6/1983 Japan .

60-119482 8/1985 Japan .

0689906 10/1979 U.S.S.R. ..... 198/367

*Primary Examiner*—F. J. Bartuska

*Attorney, Agent, or Firm*—Lowe, Price, LeBlanc & Becker

[57] ABSTRACT

In a slot machine island wherein gaming medals can be distributed into juxtaposed slot machines and medal lending machines by a distributing conveyor belt extended in a horizontal direction; a medal distribution apparatus characterized by being so constructed that shafts each of which is rotated forwards and reversely by a reversible motor or a rotary solenoid are stretched across the conveyor belt inwards of respective release ports which are provided at predetermined intervals sideways of the conveyor belt, and that a guide valve is fixed to each of the shafts so as to fall, when its lower edge has approached the top surface of the conveyor belt in parallel therewith, into a shape in which the guide valve is located aslant the widthwise direction of the conveyor belt and is inclined relative to the corresponding release port.

4 Claims, 4 Drawing Sheets

MEDAL DISTRIBUTION APPARATUS FOR SLOT MACHINE ISLAND

DESCRIPTION

1. Technical Field

The present invention relates to a medal distribution apparatus for a slot machine island wherein gaming medals are distributed and fed into slot machines and medal lending machines by a distributing conveyor belt.

2. Background Art

As seen in Japanese Utility Model Registration Application No. 100785/1984 already filed by the applicant of the present application, there has heretofore been known an apparatus in a slot machine island wherein gaming medals can be distributively fed into juxtaposed slot machines and medal lending machines by a distributing conveyor belt extended in a horizontal direction, the apparatus being so constructed that a plurality of distributors are disposed midway of the conveyor belt and that the respective distributors have shutters, which are actuated independently of one another in an electromagnetic fashion, and are interposed between the distributors and the conveyor belt.

Such a structure, however, has had the problem that, in the case where the gaming medals in the shape of coins are switchingly distributed from the conveyor belt, the belt cannot be smoothly turned, so the medals do not travel or become entangled to form an obstacle. Moreover, since the distributors are respectively actuated by signals, wiring within the slot machine island becomes complicated, so that when any trouble occurs, it is difficult to deal with.

DISCLOSURE OF THE INVENTION

The present invention is intended to solve such problems as are mentioned above in as simple a manner as possible. With this intention in mind, it is so constructed that shafts, each of which are rotated backwards and forwards by a reversible motor or a rotary solenoid, are stretched across a conveyor belt inwards of respective release ports which are provided at predetermined intervals to the side of the conveyor belt: A guide valve is fixed to each shaft so as to fall, when its lower edge has approached a top surface of the conveyor belt in parallel therewith, into a shape in which the guide valve is located slanting in a widthwise direction of the conveyor belt and is inclined relative to the corresponding release port.

In addition, the invention is so constructed that a shutter which opens or shuts the corresponding release port is mounted on a distal end side of the each shaft, a bellows chute of square cross section is joined to a lower part of a hopper which is disposed outside and below the corresponding release port, or three reversible motors or rotary solenoids, two of which are respectively adjacent to each other, are wired in a triplet and are secured to a frame plate.

Consequently, the guide valves can be swiveled over the parts of the conveyor belt confronting the respective release ports by the reversible motors or the rotary solenoids, so that gaming medals can be reliably and efficiently guided into the release ports by the guide valves, while at the same time, the shutters can be reliably and efficiently opened or shut. Thus, the gaming medals released through the release ports are supplied into slot machines and medal lending machines while flowing out smoothly without becoming entangled.

PREFERRED EMBODIMENT OF THE INVENTION

Figure 1:
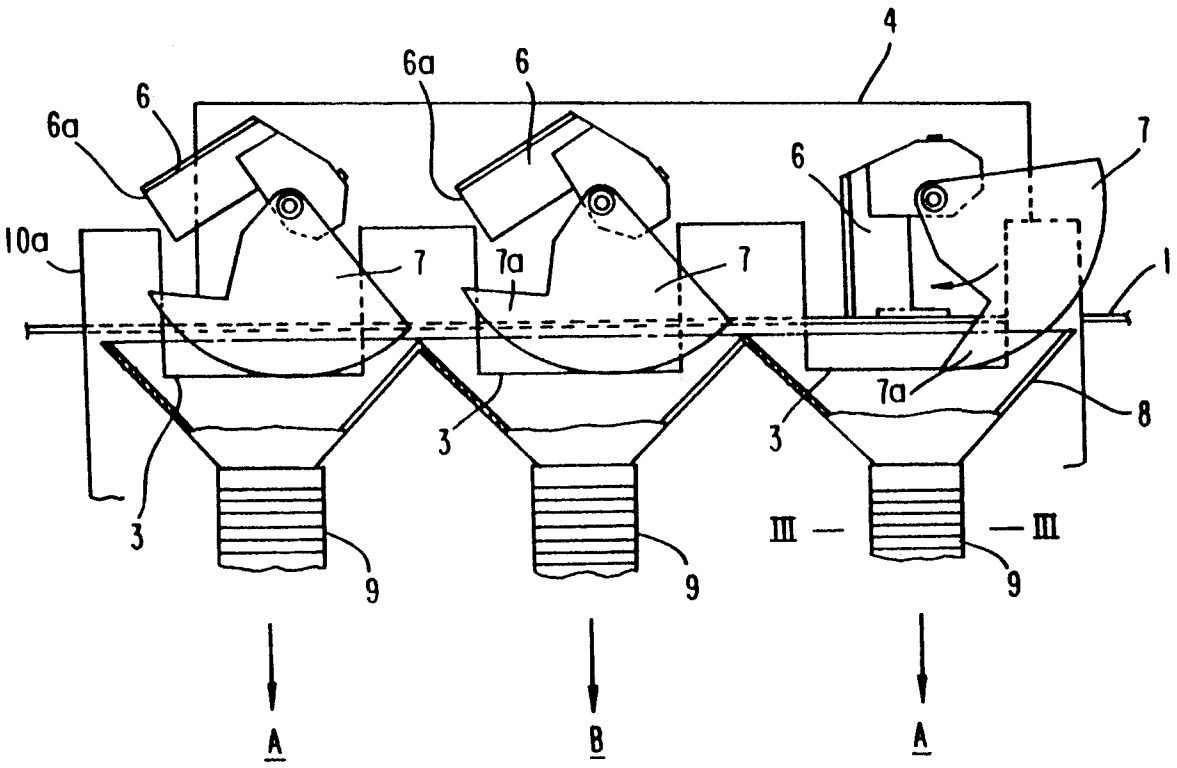
FIG. 1 is a front view of the essential portions of a medal distribution apparatus which is an embodiment of the present invention.

Best Modes for Carrying Out the Invention

Now, embodiments shown in the drawings will be described.

At the upper part of a slot machine island which is so constructed that a large number of slot machines A (not shown) are juxtaposed with medal lending machines B (not shown) held therebetween, a distributing conveyor belt 1 which feeds gaming medals 2 distributively into the respective machines is extended in a horizontal direction, thereby constructing a medal distribution apparatus similarly to the prior-art structure. Herein, however, three release ports 3 are formed at intervals by cutting out the intermediate parts of a side plate 10*a* which is erected midway and sideways of the conveyor belt 1. Hoppers 8 are respectively installed outside and below the three release ports 3. Square cross section bellows chutes 9 for feeding the gaming medals, are respectively suspended from the lower openings 8*a* of the individual hoppers 8. The central bellows chute 9 has its lower part joined to the medal lending machine B, while both the sideward bellows chutes 9, 9 have their lower parts joined to both the sideward slot machines A, A respectively.

A frame plate 4 which extends along the inner sides of the three release ports 3, is mounted upright outside an inner side plate 10*b*. Outside the frame plate 4, three reversible motors 5 or rotary solenoids which are wired in a triplet and which are installed on this frame plate 4 are respectively arranged confronting the inner sides of the release ports 3. Thus, any problem with the triplet motors can be sensed by one of the three.

In addition, guide valves 6 are respectively fixed to the shafts 5*a* of the three motors 5 in such a manner that, when the lower edge 6*a* of each of the guide valves has approached the top surface of the conveyor belt 1 in parallel therewith, the guide valve falls into a shape in which it is located aslant the widthwise direction of the conveyor belt 1 and is inclined relative to the corresponding release port 3. Shutters 7 made of sectorial plates, each of which is formed with a lug 7*a* at the lower side end part thereof, have their upper parts fixed respectively to the distal end sides of the shafts 5*a* of the motors 5 into structures unitary with the corresponding guide valves 6, in such a manner that each of the shutters 7 can swivel outside the corresponding release port 3.

Figure 2:
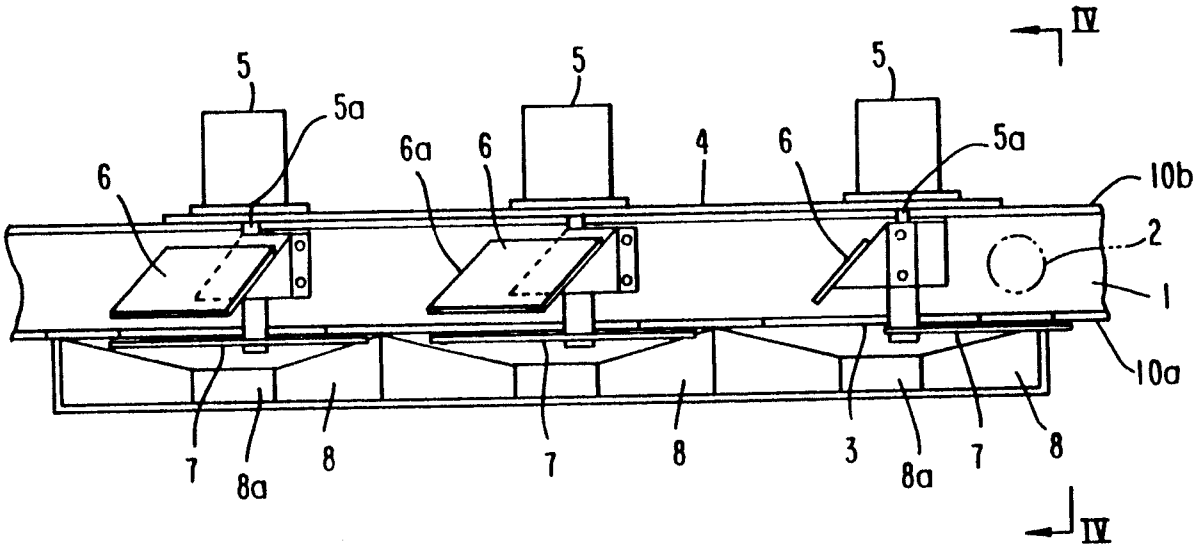
FIG. 2 is a plan view of the above essential portions.
Figure 3:
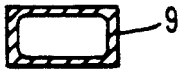
FIG. 3 is a sectional view taken along line III—III in FIG. 1.
Figure 4:
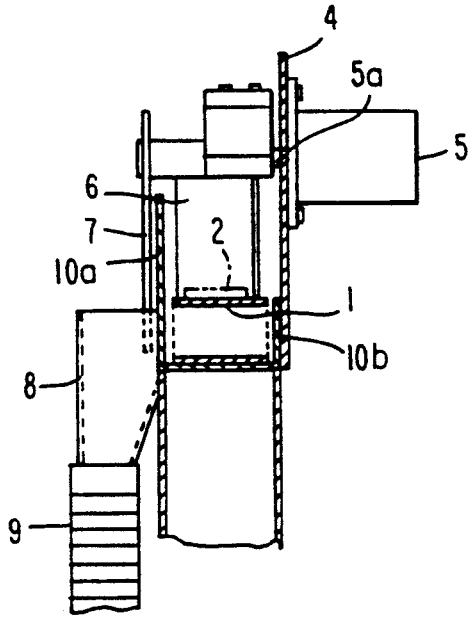
FIG. 4 is a view taken along line IV—IV in FIG. 2.
Figure 5:
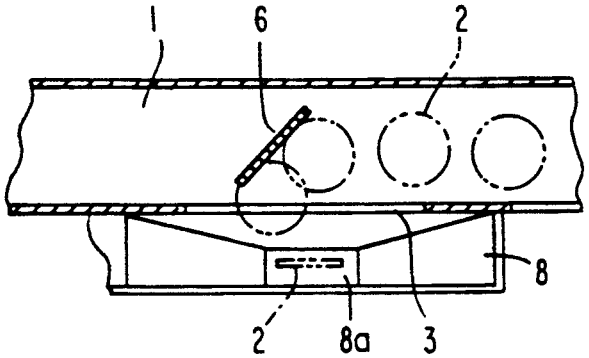
FIG. 5 is an explanatory view.

As illustrated in FIGS. 1 and 2, accordingly, when the right motor 5 as viewed in the drawing is started upon receipt of a signal, the guide valve 6 is swiveled so as to bring its lower edge 6*a* close to the top surface of the conveyor belt 1, and the shutter 7 is also swiveled to open the release port 3. As shown in FIG. 5, therefore, the gamming medals 2 carried in by the conveyor belt 1 are guided as indicated by an arrow by means of the guide valve 6, to drop directly from the release port 3 into the hopper 8 and to flow down inside the bellows chute of the square cross section 9 smoothly without becoming entangled, until they are supplied into the slot machine A.

In that state, as illustrated in FIGS. 1 and 2, the other two release ports 3 are shut by the respectively corresponding shutters 7, and both the guide valves 6 are swiveled upwards so as not to obstruct the conveyance of the gaming medals 2. Meanwhile, in case of cutting of the gaming medals 2 from the right release port 3, when the motor 5 is reversed by a signal, the guide value 6 and the shutter 7 are swiveled as indicated by an arrow in FIG. 1. Then, the shutter 7 shuts the release port 3 while the lug 7*a* thereof is distributing the gaming medals 2 having come to this port, to either the conveyor belt or the hopper in a scooping fashion. Simultaneously, the guide valve 6 is turned upwards so as not to be obstructive.

Moreover, since the three motors in the triplet are interconnected and are mounted on the frame plate 4, any problem with the triplet can be favorably sensed by one of the motors and can be easily dealt with.

Figure 6:
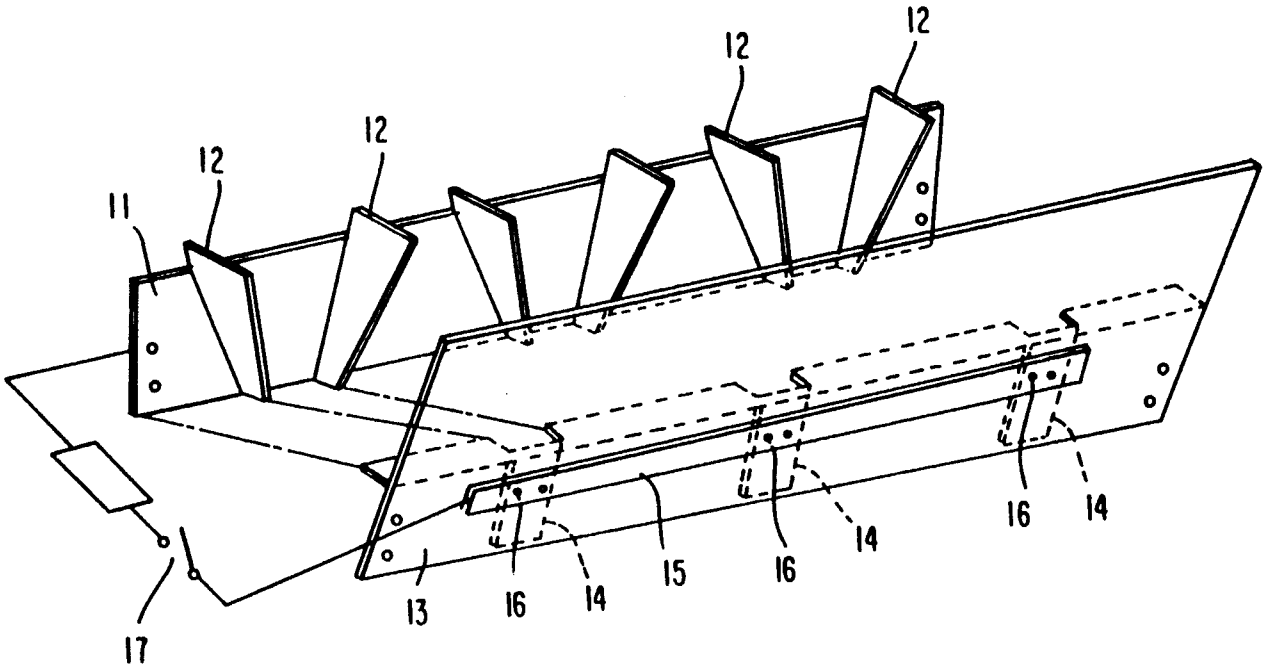
FIG. 6 is an exploded perspective view of another embodiment of the present invention.

FIG. 6 is an exploded view in perspective of another embodiment of the present invention, in which when the gaming medal falls into such a condition that it turns sideways and so lies still with the hopper, an electrically-conductive state is established, and thus the condition can be detected. The hoppers are respectively installed below the three release ports 3 and the bellows chutes 9 are joined to the hoppers, respectively, in the foregoing embodiment. Three sets of sink plates 12 made of an acrylic resin are secured to a metal plate 11 in such a manner that each set is in a flaring shape narrowed downwards. A support plate 13 made of an acrylic resin is mounted in correspondence with the metal plate 11 and so as to define a narrower spacing therefrom downwards. Stainless steel plates 14 which confront the corresponding interspaces between the sink plates 12, 12 in the three sets are respectively disposed on the inner surface of the support plate 13. Also, a metal strap 15 abutting on the outer surface of the support plate 13 is mounted by metallic clamping means such as bolts 16 in the state in which it is electrically conductive with the respective stainless steel plates 14. The metal plates 11 and 15 are connected through a switch 17 or the like. Thus, when the gaming medal dropping between the sink plates 12, 12 has fallen into such a condition that it turns sideways and so lie still, it comes into contact with both the metal plate 11 and the stainless steel plate 14 to establish an electrically-conductive state, and the condition can this be detected.

Industrial Applicability

In this manner, according to the present invention, guide valves can be favorably swiveled over the parts of a conveyor belt confronting respective release ports by reversible motors, so that gaming medals can be guided into the release ports reliably, and smoothly by the guide valves, while at the same time, shutters can be opened or shut reliably. Thus, the gaming medals released through the release ports are supplied into slot machines and medal lending machines while flowing smoothly without becoming entangled, by bellows chutes of square cross section. The invention has the merits of a compact structure and a preferable practicability.

We claim:

1. A medal distribution apparatus for a slot machine esland wherein gaming medals can be distributed into juxtaposed slot machines and medal lending machines by a distributing conveyor belt extended in a horizontal direction, the medal distribution apparatus comprising:
   - shafts rotated backwards and forward, stretched across said conveyor belt and positioned inward of respective release ports which are provided at predetermined intervals of said conveyor belt;
   - a guide valve fixed to each shaft so as to fall, when its lower edge has approached a top surface of said conveyor belt in parallel therewith, into a shape in which said guide valve is located aslant in a widthwise direction of said conveyor belt and is inclined relative to the corresponding release port; and
   - a shutter, which opens or shuts said corresponding release port, mounted on a distal end side of each shaft.

2. A medal distribution apparatus for a slot machine island as defined in claim 1, wherein a bellows chute of square cross section, which feeds the gaming medals into the corresponding slot machine or medal lending machine, is joined to a lower part of a hopper, which is disposed outside and below said corresponding release port.

3. A medal distribution apparatus for a slot machine island as defined in claim 1, wherein each shaft is rotated backward and forward by one of a reversible motor and a rotary solenoid, two of which are respectively adjacent to each other, are wired in a triplet and are secured to a frame plate.

4. A medal distribution apparatus for a slot machine island as defined in claim 1, wherein each shaft is rotated backward and forward by one of a reversible motor and a rotary solenoid.

* * * * *